United States Patent [19]

Kester

[11] Patent Number: 4,979,156

[45] Date of Patent: Dec. 18, 1990

[54] SCREW-ON WATCH STEM SEAL

[76] Inventor: Lynn C. Kester, 4208 Emil, Amarillo, Tex. 79106

[21] Appl. No.: 385,397

[22] Filed: Jul. 27, 1989

[51] Int. Cl.[5] ..... G04C 3/00

[52] U.S. Cl. ..... 368/289; 368/306; 368/308; 368/319

[58] Field of Search ..... 368/288, 289, 290, 319, 368/320, 321, 306, 308

[56] References Cited

U.S. PATENT DOCUMENTS

| | | | |
|---|---|---|---|
| 621,887 | 3/1899 | Yeakel | 368/306 |
| 2,867,079 | 1/1959 | Pfisterer | 368/289 |
| 3,475,901 | 11/1969 | Soguel | 368/289 |
| 3,614,865 | 10/1971 | Widmer et al. | 368/289 |
| 3,699,767 | 10/1972 | Piquerez et al. | 368/319 |
| 4,152,889 | 5/1979 | Sekiguchi | 368/319 |
| 4,292,682 | 9/1981 | Wenger | 368/289 |
| 4,346,464 | 8/1982 | Wenger | 368/319 |
| 4,403,870 | 9/1983 | Thompson et al. | 368/309 |
| 4,430,532 | 2/1984 | Matsumoto | 368/290 |

FOREIGN PATENT DOCUMENTS

| | | | |
|---|---|---|---|
| 220261 | 7/1942 | Switzerland | 368/290 |
| 740123 | 11/1955 | United Kingdom | 368/289 |

*Primary Examiner*—Bernard Roskoski

*Attorney, Agent, or Firm*—Fleit, Jacobson, Cohn, Price, Holman & Stern

[57] ABSTRACT

A seal assembly which is screw threaded onto the stem of a wrist watch with the seal and stem being related to a tube connected with the watch case in a conventional manner. The screw-on seal of this invention includes an internally threaded member engaged with an externally threaded portion of the watch stem with the exterior surface of the internally threaded member being provided with a groove or notches receiving an O-ring seal to enable relatively quick and easy repair of a watch when an existing stem is broken due to weakened areas in the stem formed when a conventional seal is positioned in a groove on the stem. This seal assembly can also be used in new watch construction especially when installed in combination with a conventional water seal crown thereby providing double protection against entry of water, moisture, dust and similar material that may adversely affect the operation of the watch.

2 Claims, 1 Drawing Sheet

SCREW-ON WATCH STEM SEAL

BACKGROUND OF THE INVENTION

1. Field of the Invention

The present invention generally relates to seal for a watch stem and more specifically a seal assembly which is screw threaded onto the stem of a wrist watch with the seal and stem being related to a tube connected with the watch case in a conventional manner with the screw-on seal of this invention including an internally threaded member engaged with an externally threaded portion of the watch stem with the exterior surface of the internally threaded member being provided with a groove or notches receiving an O-ring seal to enable relatively quick and easy repair of a watch when an existing stem is broken due to weakened areas in the stem formed when a conventional seal is positioned in a groove on the stem.

2. Information Disclosure Statement

Many watches and watch stem assemblies are provided with O-ring seals interconnecting the stem post and watch case or case tube in which the stem is grooved to receive an O-ring seal which causes a weakened area and subsequent breakage of the stem. The following U.S. patents disclose watch case structures including a stem and seal assembly.

3,699,767
4,152,889
4,292,682
4,346,464
4,403,870

While the above-listed patents disclose stem seals such as those presently used in watch structures, none of the above patents relate to a screw-on type seal engaged with an externally threaded portion of a watch stem with the screw-on seal being in the form of a nut or tube having an external groove formed therein to receive an O-ring seal which cooperates with the interior of a case tube that is rigidly press fitted into a watch case.

SUMMARY OF THE INVENTION

An object of the present invention is to provide a watch stem seal which includes an internally threaded nut in the form of a tube or disc threaded onto a stem that has the crown connected with the outer end thereof and the inner end extending inwardly into the watch case with the nut including an external peripheral groove receiving an O-ring seal which cooperates with the interior surface of a tubular member connected with or forming part of the watch case to form an effective seal between the stem and watch case.

Another object of the invention is to provide a watch stem seal which enables easy and quick replacement and effective sealing of a watch stem.

Still another object of this invention is to provide a seal assembly which can also be used in new watch construction especially when installed in combination with a conventional water seal crown thereby providing double protection against entry of water, moisture, dust and similar material that may adversely affect the operation of the watch.

A further object of the invention is to provide a watch stem seal which is quite simple in construction, easy to install and relatively inexpensive to manufacture with the screw threaded nut engaging an externally threaded portion of a watch stem.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
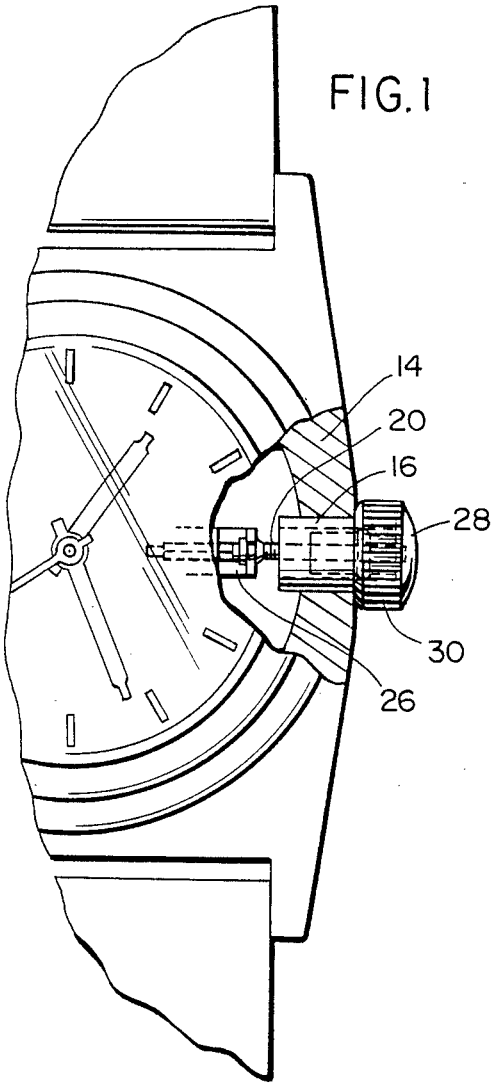
FIG. 1 is a plan view of a watch case with portions broken away illustrating the case tube, stem and crown with the screw-on seal of the present invention incorporated therein.
Figure 3:
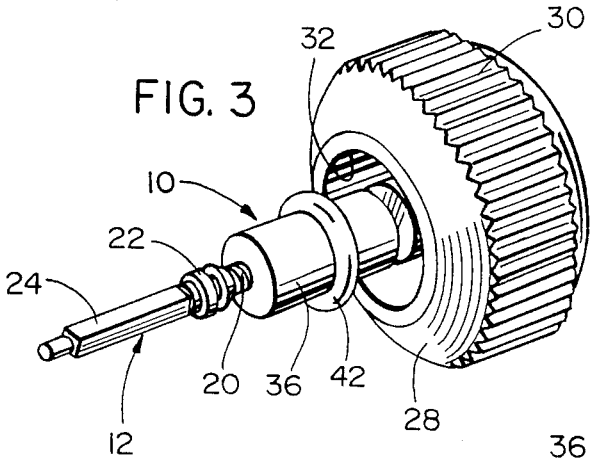
FIG. 3 is a perspective view of the assembled crown, stem and screw-on seal of this invention.
Figure 4:
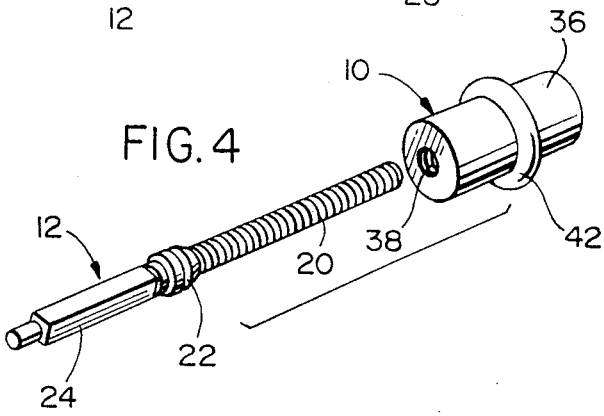
FIG. 4 is an exploded perspective view of the watch stem and screw-on seal.

The screw-on seal illustrated in FIGS. 1–4 is generally designated by reference numeral 10 and is associated with a watch stem 12 such as that illustrated in FIG. 4. The watch stem 12 is associated with a watch case 14 having a case tube 16 mounted in an aperture 18 in the watch case 14 in a conventional manner with the case tube being press fitted into the opening 18 or integral with the watch case 14. The watch stem 12 is of conventional construction and includes an elongated externally threaded portion 20, a grooved portion 22 and a square or polygonal portion 24 connected with the interior components 26 of the watch in a conventional and well-known manner. The outer end of the stem 12 is provided with a crown 28 in the form of a generally cylindrical body having a serrated or knurled outer surface 30 and an interior groove 32 which axially receives the outer end of the case tube 16 with the center of the crown including an internally threaded blind bore 34 which is connected to the end of the threaded portion 20 of the watch stem 12 in a conventional and well-known manner.

Figure 2:
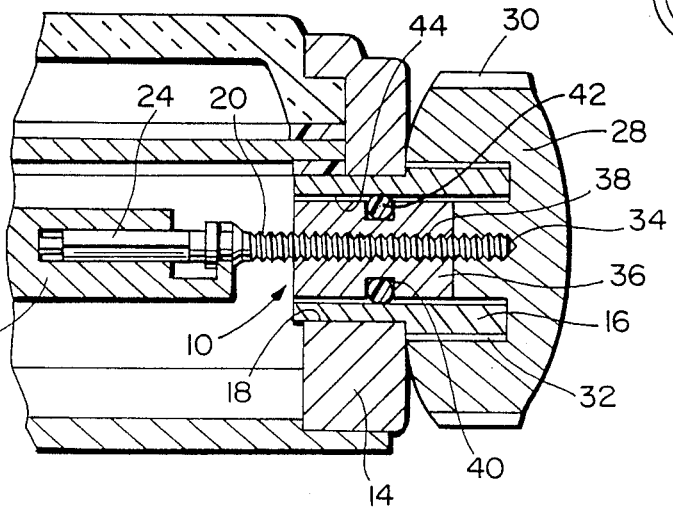
FIG. 2 is a detailed sectional view, on an enlarged scale, of the construction of FIG. 1 illustrating the association of the components of the seal of this invention associated with the watch case, crown and case tube.

The screw-on seal of the present invention as illustrated in FIG. 4 includes a tubular body or sleeve 36 that is internally threaded at 38 throughout its length as illustrated in FIG. 2. The external surface of the tubular body or sleeve 36 is provided with a peripheral groove or notch 40 which receives an O-ring seal 42 therein which engages the internal surface 44 of the case tube 16 in the manner illustrated in FIG. 2 thereby forming a seal between the tubular body or sleeve 36 and the case tube 16.

Figure 5:
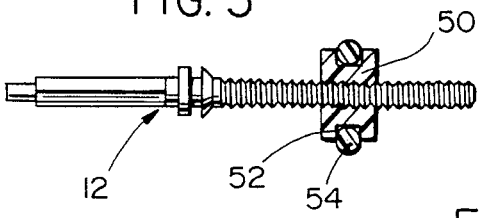
FIG. 5 is a sectional view of the screw-on seal of this invention illustrating a slightly different configuration of the seal that engages the threaded watch stem.
Figure 6:
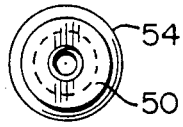
FIG. 6 is an end view of the screw-on seal illustrated in FIG. 5.

In the embodiment of the invention illustrated in FIGS. 5 and 6, a generally disc-type nut 50 is mounted on the threaded portion 20 of the stem 12 with the nut 50 including a peripheral groove 52 receiving a seal in the form of an O-ring seal 54 in the same manner that the seal 42 is associated with the tubular body or sleeve 36 in FIGS. 1–4 and is associated with the case tube 16 in the same manner.

When the screw-on seal 10 illustrated in FIGS. 1–4 or the screw-on seal 50 illustrated in FIGS. 5 and 6 is assembled on the stem, the internal threads of the tubular body 36 or the disc nut 50 are screw threaded onto the screw threaded portion 20 of the stem 12 with the stem nut being abuttingly engaged with the interior of the crown 28 as illustrated in FIG. 2. FIG. 2 illustrates the association of the screw-on seal with the crown 28, the screw threaded portion 20 of the stem 12 and the interior surface of the case tube 16 in order to provide an effective seal for the watch case 14 to resist entry of dust, water, moisture and the like.

The screw-on tubular body or sleeve 36 or nut 50 may be constructed of metal or a wear resistant plastic material such as nylon or the like and the O-ring seal or gasket is preferably constructed of rubber or other resilient material. The stem 12 is conventionally metal material and the thread configuration of the screw-on seal is the same as the thread configuration on the threaded portion 20 of the stem 12. The screw-on nut or seal can also be used to repair broken stems if the break in the stem is in the threaded area with the nut being sufficiently long to enable the two broken ends of the existing stem to be threaded into the screw-on nut from opposite ends. The screw-on seal of the present invention can be quite easily and rapidly mounted in position by being merely screwed onto the stem 12 and, after the crown is attached to the stem 12, the screw-on nut is threaded to abut the end of the screw-on seal nut with the crown thus forming a rigid assembly and an effective seal and enabling quick and rapid repair of broken watch stems with the repaired or replaced stem having an effective seal between the stem and case tube or case.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination, a watch case, a case tube rigid with the case and extending through the case, a watch stem extending into the case tube in concentrically spaced relation and including a screw threaded end portion, a crown screw threaded onto the outer end of the stem, and a screw-on seal threadedly mounted on the threaded end portion of the stem and including a peripheral seal member in sealed engagement with the interior of the case tube, said screw-on seal including a tubular internally threaded member having one end abutting the crown with the periphery positioned within the case tube, said seal member being in the form of an O-ring of resilient material engaged with the interior surface of the case tube, said tubular member having recess means in the periphery thereof receiving said O-ring to retain it mounted on the tubular member.

2. The combination as defined in claim 1 wherein said crown includes an annular groove extending axially into the surface thereof facing the watch case, said case tube extending telescopically into said annular groove.

* * * * *